US006202869B1

(12) United States Patent
Sullivan

(10) Patent No.: US 6,202,869 B1
(45) **Date of Patent: *Mar. 20, 2001**

(54) CHILD-RESISTANT/SENIOR-FRIENDLY CONTAINER

(76) Inventor: Scott L Sullivan, 3 Garden Ridge, Chappaqua, NY (US) 10514

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/281,912

(22) Filed: Mar. 31, 1999

Related U.S. Application Data

(60) Provisional application No. 60/080,263, filed on Apr. 1, 1998.

(51) Int. Cl.[7] ..... B65D 41/04; B65D 55/02

(52) U.S. Cl. ..... 215/217; 215/219; 215/223; 215/305; 215/330; 215/334; 220/281

(58) Field of Search ..... 215/217, 201, 215/208, 223, 218, 219, 305, 330, 334, 335, 301, 207, 204, 220, 295, 333, 329; 220/212.5, 255, 257, 263, 266, 281, 283, 334; 222/153.1

(56) References Cited

U.S. PATENT DOCUMENTS 5,115,928 * 5/1992 Drummond, Jr. ..... 215/219
5,158,194 * 10/1992 Sirgo et al. ..... 215/219
5,170,900 * 12/1992 Maneral ..... 215/218
5,344,035 * 9/1994 Manera ..... 215/219
5,509,550 * 4/1996 DeJonge ..... 215/204
5,524,779 * 6/1996 Faile ..... 215/219 X
5,579,932 * 12/1996 Drozd et al. ..... 215/217 X
5,597,083 * 1/1997 Childers et al. ..... 215/223 X
5,676,268 * 10/1997 King ..... 215/217 X

* cited by examiner

*Primary Examiner*—Allan N. Shoap
*Assistant Examiner*—Niki M. Eloshway

(57) ABSTRACT

A child-resistant/senior-friendly container includes a cap assembly having a retainer that is adapted to thread onto the container, and an outer skirt loosely fitted around the retainer. The skirt includes at least one grasping member which is pivotal between a disengaged position wherein the skirt may freely rotate with respect to the retainer and an engaged position wherein the skirt engages the retainer. In the engaged position, both the skirt and the retainer may be rotated and removed from the container. The retainer cannot be rotated when the grasping member is located in the disengaged position. A handle may be attached to the skirt, between two opposing and pivotal grasping members so provide leverage in rotating the cap from the container when the grasping members are in the engaged position.

16 Claims, 12 Drawing Sheets

CHILD-RESISTANT/SENIOR-FRIENDLY CONTAINER

This patent application claims the priority of U.S. provisional patent application No. 60/080,263, filed Apr. 1, 1998 (entitled: "Child-Resistant/Senior-Friendly Container"), which is incorporated herein by reference.

BACKGROUND OF THE INVENTION a) Field of the Invention

This invention generally relates to medicine containers having lockable closures, and more particularly, to such containers wherein the lockable closures are both child-resistant and adult (or senior) friendly.

b) Description of Prior Art

The Poison Prevention Packaging Act went into effect in 1970 requiring that certain harmful packaged materials, including poisons, certain chemicals, and medications be contained in child-resistant containers (or CRC's). In response to this act, and public demand, there have been a multitude of containers offered to package such dangerous materials. Among these containers include the "Clic-Loc" closure which requires a user to rotate the cap with respect to the container until two marks (arrows) align, at which point a finger tab may be moved upward and the cap pried from the container to an open position.

Another type of CRC is a "push and turn" type and includes a cap having an outer shell and an inner sealing retainer. The outer shell freely rotates about the inner sealing retainer until a predetermined downward force is applied by the adult user. The downward force engages the outer shell with the inner retainer and must be maintained throughout the opening procedure. The retainer includes conventional threads and once engaged with the outer shell, its rotation by the adult user will open the container.

Although these conventional containers discourage children from gaining access to the medicine or chemicals located within the container while providing fair access to adults, the operations required to open these containers have proven to be very difficult to perform by elderly, disabled, inured or by those otherwise lacking in hand coordination.

A problem with the conventional "push and turn" containers is that during opening, the user must force the cap towards the container body to ensure that the outer skirt remains engaged with the inner retainer, while the cap is rotated away from the container body. This opposing mechanical action required to open the conventional "push and turn" child-resistant containers is very uncomfortable to the user and only adds to the difficulty and frustration in opening the container. The user ends up "fighting" against his own action, as he opens the container.

Owing to the difficulties in opening conventional child-resistant containers, many users may deliberately leave the container or package open so that they may readily access their medicine in the future. An obvious problem resulting in leaving a medicine container open or effectively open (i.e., disabling any child resistant lock) is that children also may gain access to the medicine. Each year, approximately 130,000 people are treated in hospital emergency rooms for accidental poisoning resulting from prescription drugs, and certain over-the-counter drugs, such as aspirin, and of these poisonings, about 50 children die.

Recently, there has been interest in supplying a new type of container called "senior-friendly" containers (SFC's) to those adults who have difficulty in manipulating conventional CRC's or even regular, non-child resistant containers. For the most part, these senior-friendly containers have provisions which allow the elderly (or those otherwise lacking in hand coordination) to easily open the container, but unfortunately do not also include child-proof features to prevent access of the drugs to children.

On Jun. 15, 1995, the U.S. Consumer Product Safety Commission (CPSC) voted to revive the test-procedures used under the Poison Prevention Packaging Act to make packaging easier to open by adults between the ages of 50 and 70, while maintaining its child resistance. The CPSC recognizes that child-resistant containers requiring two or more mental steps to be opened may sufficiently discourage children from accessing the container's dangerous contents.

OBJECTS OF THE INVENTION

It is an object of the invention to provide a closure adapted to fit a container which overcomes the problems and deficiencies of the prior art.

It is another object of the invention to provide a container having a lockable closure which includes provisions to prevent easy access to children, while allowing quick and easy access to the elderly (or those otherwise lacking in hand coordination).

It is another object of the invention to provide a container having a lockable closure which may be activated or de-activated, as desired by the user.

It is another object of the invention to provide such a container wherein a leverage handle is provided to assist in opening the container once it has been unlocked.

SUMMARY OF THE INVENTION

A child-resistant/senior-friendly container includes a body having an opening and a cap assembly. The cap assembly is made up of a retainer that is adapted to thread onto the body and thereby selectively closes the opening, and an outer skirt which is loosely fitted around the retainer. The skirt includes at least one grasping member which is pivotal between a disengaged position wherein the skirt may freely rotate with respect to the retainer and an engaged position wherein the skirt engages a portion of the retainer. In the engaged position, a user may unscrew (or otherwise rotate and release, e.g., in the case of a bayonet-type closure) the retainer from the body by rotating the surrounding skirt. The retainer cannot be rotated when the grasping member is located in the disengaged position.

According to another embodiment of the invention, a handle is attached to the skirt, preferably between two opposing and pivotal grasping members. In this embodiment, a user may squeeze the grasping members together against the handle to their engaged position and then use the leverage afforded by the handle to easily rotate the skirt and retainer from the opening of the body.

DETAILED DESCRIPTION OF THE PREFERRED EMBODIMENT

Figure 1:
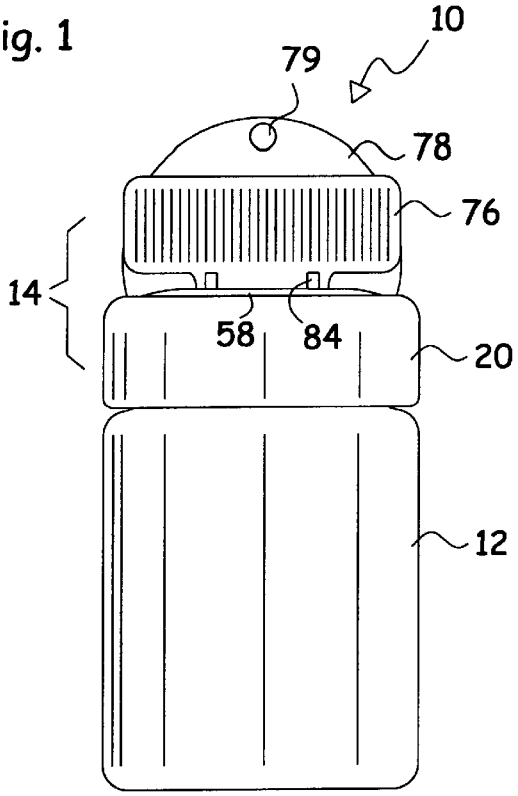
FIG. 1 is a front view of a container and cap assembly showing a handle and one of two grasping members, according to the invention.
Figure 2:
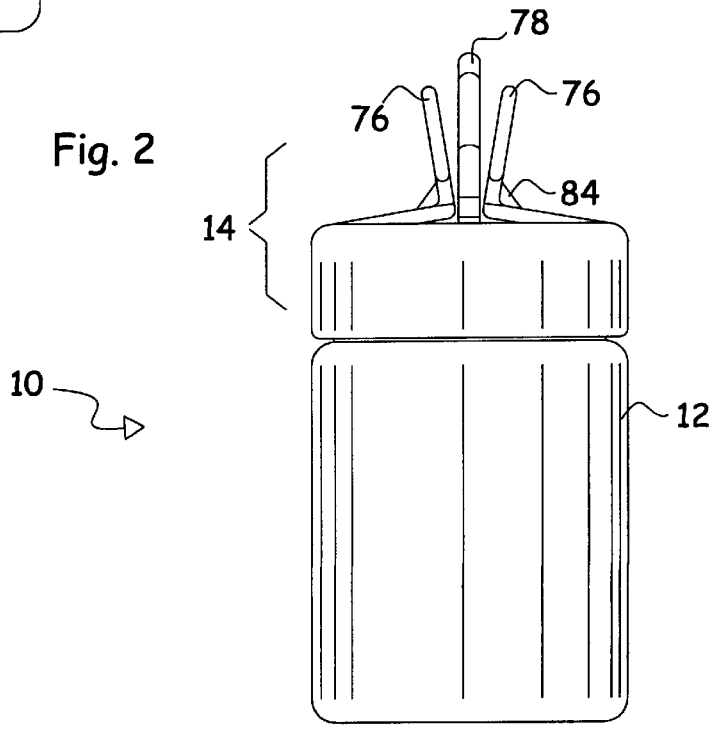
FIG. 2 is a side view of the container and cap assembly of FIG. 1 showing two opposing grasping members in a disengaged position, adjacent to the handle, according to the invention.

Referring to FIGS. 1, 2, 3, and 4 a container assembly 10 according to the invention is shown having a container body 12 and a cap assembly 14. Container body 12 is preferably made from a suitable plastic, as understood by those skilled in the art, e.g., a plastic typically used in the manufacture of over-the-counter pill containers, such as high-density polyethylene (HDPE). Container body 12 has a generally circular upper opening 16 defined by a generally circular rim 17 and surrounded by conventional screw threads 18.

Figure 3:
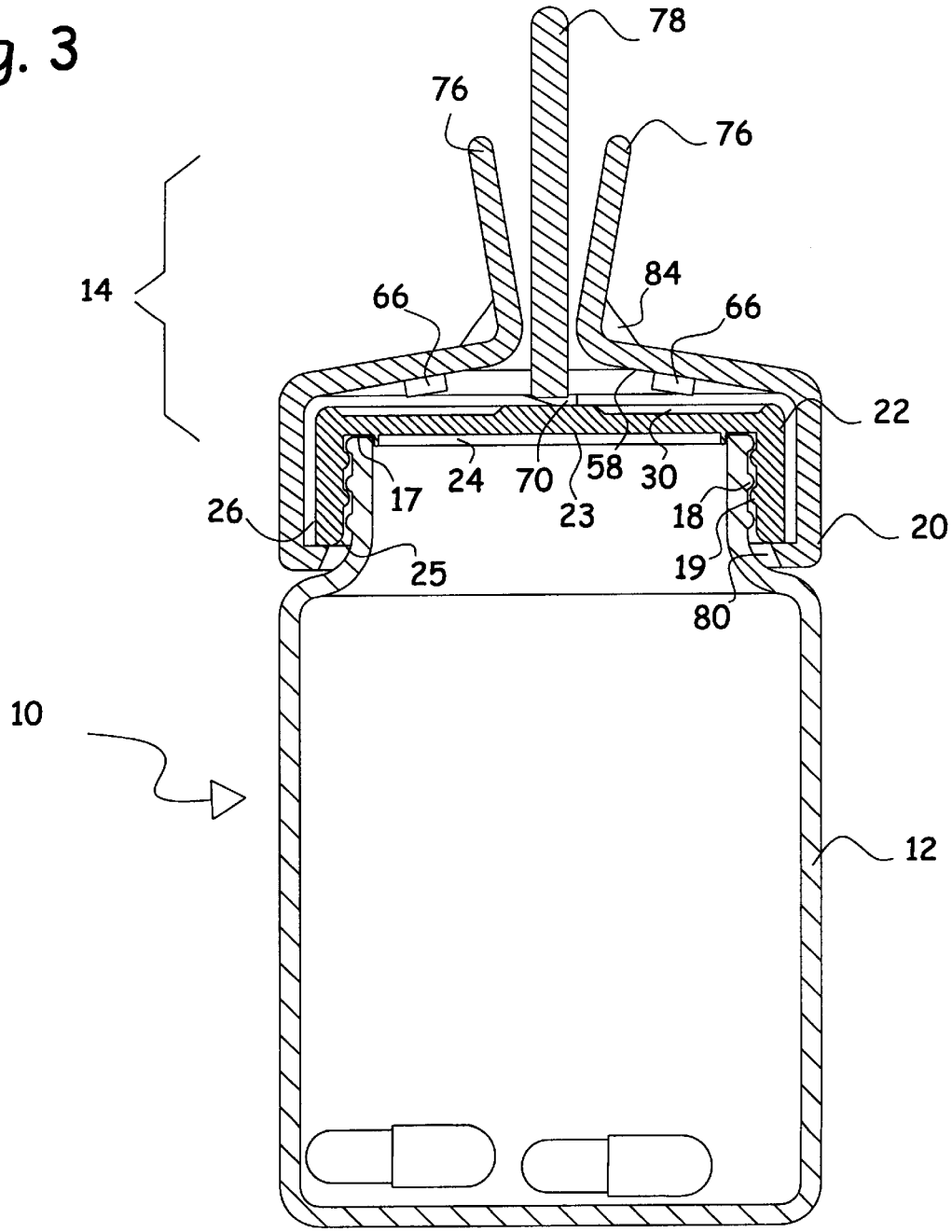
FIG. 3 is cross-sectional view of the container and cap assembly of FIG. 2, showing an outer skirt, an inner retainer, and details of a locking mechanism, according to the invention.

As shown in FIG. 3, cap assembly 14 includes an outer skirt 20 and an inner retainer 22. Retainer 22 may be conventional which may allow the present invention to be economially implemented with conventional container assemblies; only requiring the manufacture of a single part; skirt 20.

Retainer 22 is generally cylindrical in shape and includes a generally circular ceiling 23 having an annular seal 24, an inner wall surface 25, an outer wall surface 26, and a generally circular roof surface 28. Annular seal 24 is sized and shaped to engage with rim 17 of body 12, as shown in FIG. 3 and thereby provide a seal between opening 16 and retainer 22. Inner wall surface 25 includes screw threads 19 which are adapted to engage threads 18 of container body 12 and seal opening 16. Although screw threads are shown in this and following embodiments, other appropriate securing elements may be used with the present invention, including bayonet-type securing elements (not shown), as is understood by those skilled in the art.

Figure 5:
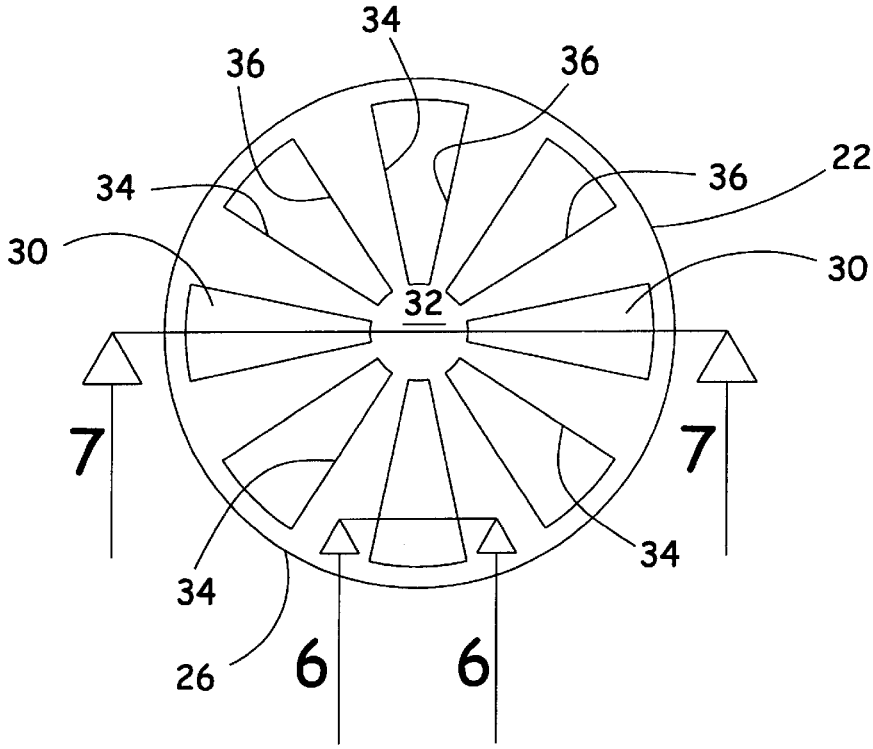
FIG. 5 is a top plan view of the inner retainer of the cap assembly showing details of radially disposed engagement recesses.
Figure 6:
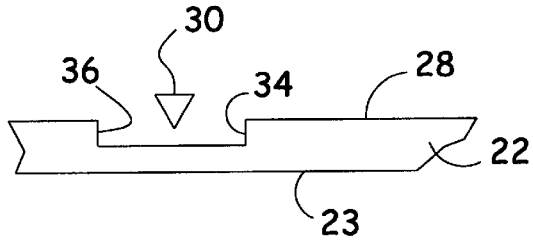
FIG. 6 is a partial sectional view of an engagement recess, taken along the lines 6—6 of FIG. 5.
Figure 7:
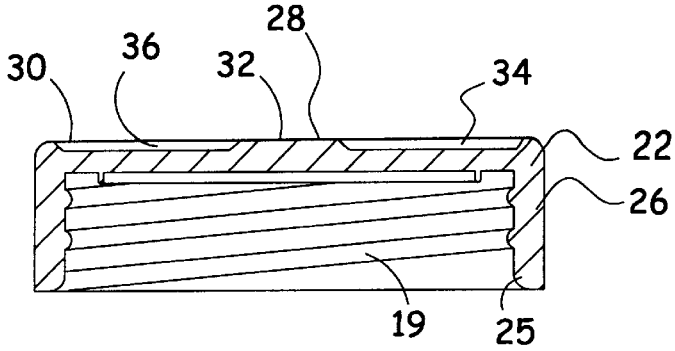
FIG. 7 is a sectional view of the inner retainer, taken along the lines 7—7 of FIG. 5.

As shown in FIGS. 5, 6 and 7, retainer 22 includes a plurality of engagement recesses 30 (eight are shown in FIG. 5) formed within roof surface 28. It is preferred that each engagement recess 30 be shaped similar to a truncated triangle, and be arranged evenly around a center point 32 of roof surface 28, as shown in FIG. 5. Center point 32 preferably functions as a bearing surface against which a portion of skirt 20 may rotate against, as explained below.

As shown in FIG. 6, each engagement recess defines a radially directed opening wall 34 and a radially directed closing wall 36. As explained in greater detail below, a portion of skirt 20 contacts opening wall 34, retainer 22 may be forced open from body 12, and when a portion of skirt 20 contacts closing wall 36, retainer 22 may be tightened to a closed position on body 12.

Referring now to FIGS. 4, 8, 9, 10 and 11, skirt 20 is shown having a shell 40 defined by a generally cylindrical side wall 42 and a generally circular upper wall 44. Upper wall 44 defines a ceiling 46 and is preferably integrally molded along an upper rim of side wall 42. A lower rim 48 of side wall 42 defines an opening 50 through which retainer 22 is inserted within shell 40, as described in greater detail below.

Figure 9:
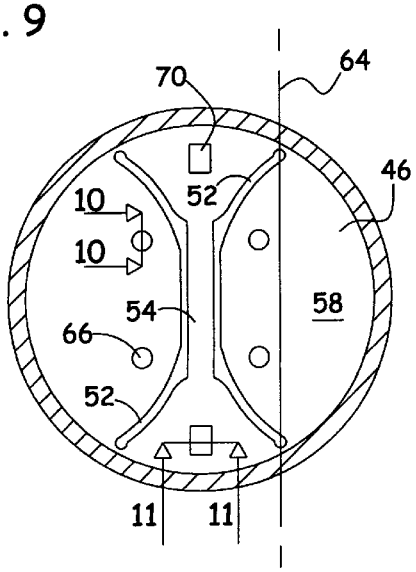
FIG. 9 is a sectional view of the outer skirt of the cap assembly, taken along the line 9—9 of FIG. 8, according to the invention.

According to a preferred embodiment of the invention, as shown in FIG. 9, upper wall 44 includes two arcuate and opposing slots 52 which together generally form the shape of an hourglass. Slots 52 define an intermediate bridging section 54, and two opposing hinging sections 58. Slots 52 are preferably symmetrical and are integrally formed during the manufacture of skirt 20.

Figure 4:
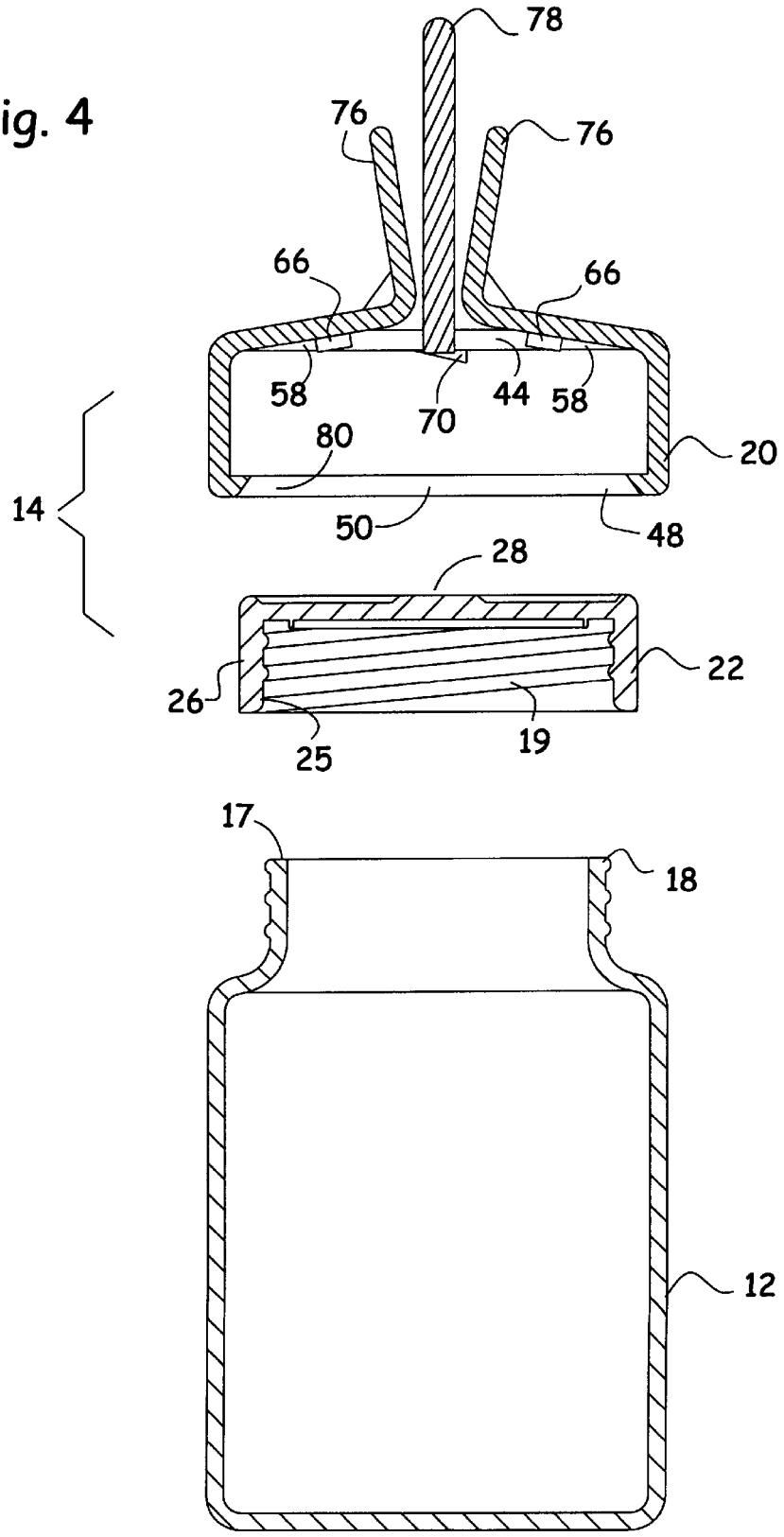
FIG. 4 is a cross-sectional assembly view of the container and cap assembly of FIG. 3, according to the invention.
Figure 8:
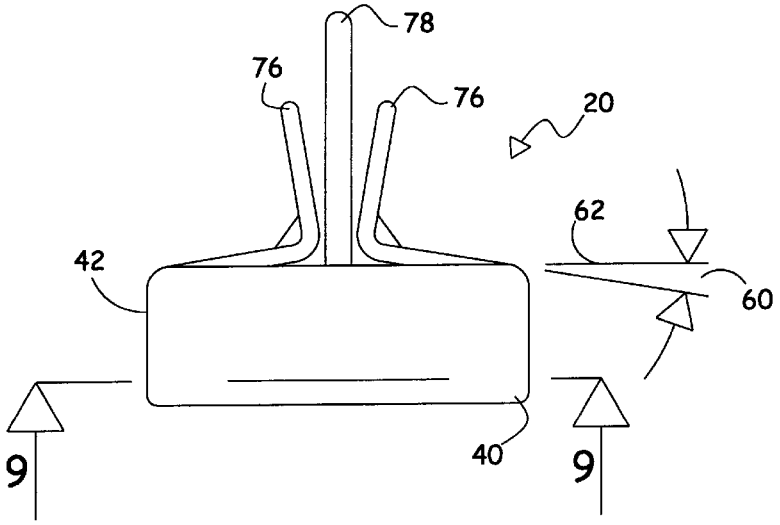
FIG. 8 is a side view of the outer skirt of the cap assembly, according to the invention.

As shown in FIGS. 4 and 8, each hinging section 58 is formed so that each will retain a memory rest position which is set to a predetermined angle 60 with respect to a plane 62 defined by the upper rim of side wall 42. This rest position is hereafter defined as a "disengaged position". Each hinging section 58 is adapted to pivot against this memory bias between the disengaged position, about a hinging axis 64 shown in FIG. 9, and an engaged position wherein each hinging section 58 is generally coplanar with plane 62, as shown in FIGS. 12, 13, 14 and 16, and described in greater detail below.

Figure 10:
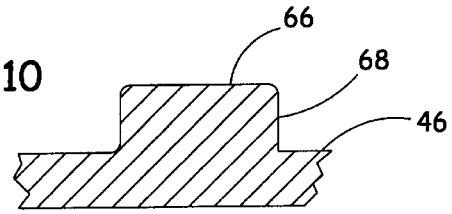
FIG. 10 is a sectional view of an engagement tab, taken along the line 10—10 of FIG. 9, according to the invention.

As shown in FIGS. 9 and 10, preferably two engagement tabs 66 are integrally formed to and extend from ceiling 46, on each respective hinging section 58 and generally adjacent to each respective slot 52. The exact arrangement of engagement tabs 66 must allow selective alignment of each engagement tab 52 with respective opening walls 34 of retainer 22, when hinging sections 58 are forced to their engaged position. Each engagement tab 66 preferably is circular in plan view and has a generally squared off sectional view, as shown in FIG. 10, defining a contact wall 68. The purpose of contact wall 68 is to abut against a respective opening wall 34 of any of engagement recesses 30 of retainer 22, during an opening procedure. It is important that engagement tabs 66 have sufficient strength and structural integrity so that collectively, they may transmit applied torque from the user turning skirt 20 directly to retainer 22, without damage and without slipping or "jumping" from a respective recess 30.

The distance each engagement tab 66 extends from its respective hinging section depends on the particulars of the overall cap design. It is important that engagement tabs 66 project sufficiently to ensure each respective contact wall 68 will sufficiently engage with a respective opening wall 34 of an engagement recess 30 when hinging sections 58 are pivoted to their engaged position, shown in FIGS. 12, 13 and 14, described below. However, engagement tabs 66 must be short enough to prevent engagement (preferably any contact) with any engagement recess 30 when hinging sections 58 are in their disengaged position, shown in FIGS. 3, 4 and 8.

Figure 11:
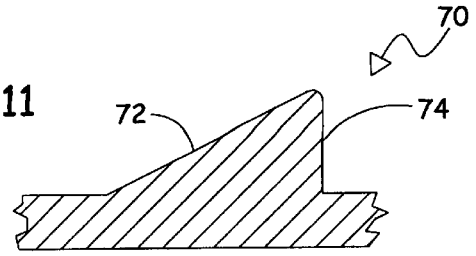
FIG. 11 is a sectional view of a closing ratchet, taken along the line 11—11 of FIG. 9, according to the invention.

As shown in FIGS. 9 and 11, at least two closing ratchets 70 are integrally formed to and extend from ceiling 46, preferably on intermediate bridging section 54. Each closing ratchet 70 is preferably generally rectangular in plan view, as shown in FIG. 9, and triangular in sectional view, as shown in FIG. 11. Each closing ratchet 70 includes a ramped surface 72 and an engagement surface 74. Closing ratchets 70 are positioned on ceiling 46 so that they align with any two opposing engagement recesses 30 so that each engagement surface 74 of each closing ratchet 70 may selectively and generally simultaneously engage with any respective closing walls 36 of the two opposing engagement recesses 30. However, closing ratchets 70 are intended to only engage with closing walls 36, and only when skirt 20 is rotated counter-clockwise with respect to retainer 22. When skirt 20 is rotated clockwise with respect to retainer 22 (with hinging sections 58 located in their disengaged position), ramped surface 72 of each closing ratchet 70 will contact opening wall 34 of each of any two opposing engagement recesses 30, but will not engage. In such instance, ramped surface 72 will slide along opening wall 34 allowing skirt 20 to freely rotate clockwise without transmitting torque to retainer 22. Such clockwise rotation will yield an audible click as each closing ratchet 70 falls into another adjacent pair of engagement recesses 30, as is understood by those skilled in the art. Closing ratchets 70 allow skirt 20 to always tighten retainer 22 onto body 12, but the ratchets themselves never transmit the required torque to allow retainer 22 to be opened. As discussed below, retainer 22 may only be opened by pivoting hinging sections 58 to their engaged position, as shown in FIG. ( ), and rotated skirt 20.

Skirt 20 and/or ratchets 70 may be molded integrally so that ratchets 70 have an inherent flexibility allowing them to easily pass over adjacent engagement recesses 30 when skirt 20 is rotated counter-clockwise, yet easily engage with any engagement recess 30, as described above, when skirt 20 is rotated clockwise, perhaps using a little downward force as necessary. The use of ratchets 70 to assist in closing a cap onto a container is well known by those skilled in the art. According to the invention, ratchets 70 may be placed in a variety of locations, including side walls 26 of retainer 22 to selectively engage corresponding engaging elements (not shown) located along the inside wall surfaces of skirt 20.

Adjacent to each slot 52 and generally perpendicular to each respective hinging section 58 is a grasping member 76, as shown in FIG. 8. Each grasping member 76 extends generally perpendicularly from each respective hinging section 58. A rigid handle 78 is preferably integrally formed to skirt 20, extending generally perpendicular from plane 62 along intermediate bridging section 54. Handle 78 is preferably rigidly connected to skirt 20 and may be used by the adult user to assist in opening the container, as described below. Handle 78 and each opposing grasping member 76 are preferably shaped to prevent children from reaching both grasping members 76, as described below. Grasping members 76 may also be otherwise protected from inadvertent access using shaped shields (not shown) which may be integrally molded from handle 78 and may extend around a portion of each grasping member 76.

Lower rim 48 of skirt 20 preferably includes a beveled edge 80 which allows one-way "snap" insertion of retainer 22 into skirt 20, yet prevents removal of retainer 22 from skirt 20 once inserted, as understood by those skilled in the art.

Figure 12:
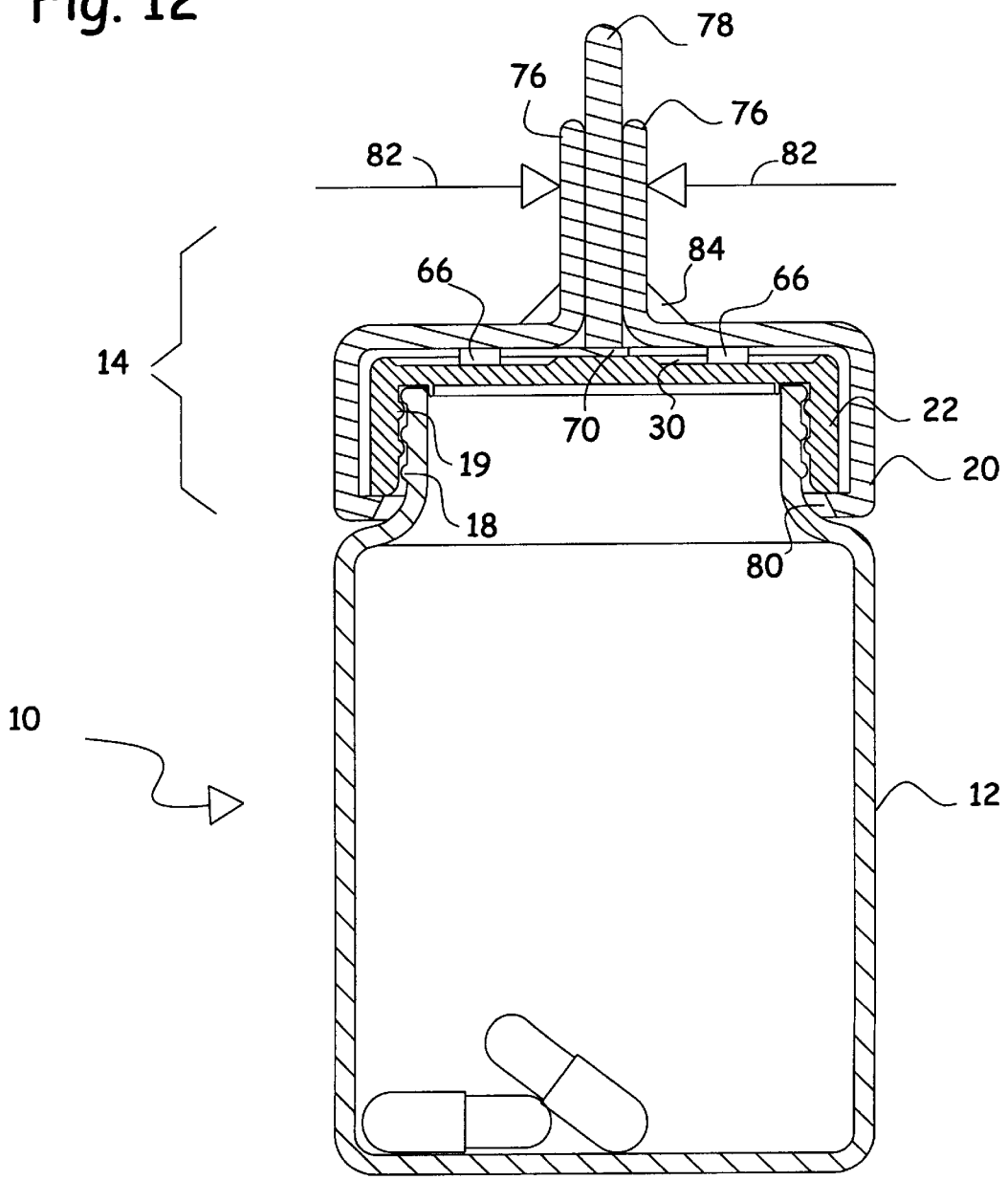
FIG. 12 is an enlarged cross-sectional side view of the container assembly according to the invention, showing the cap assembly in its engaged position.
Figure 14:
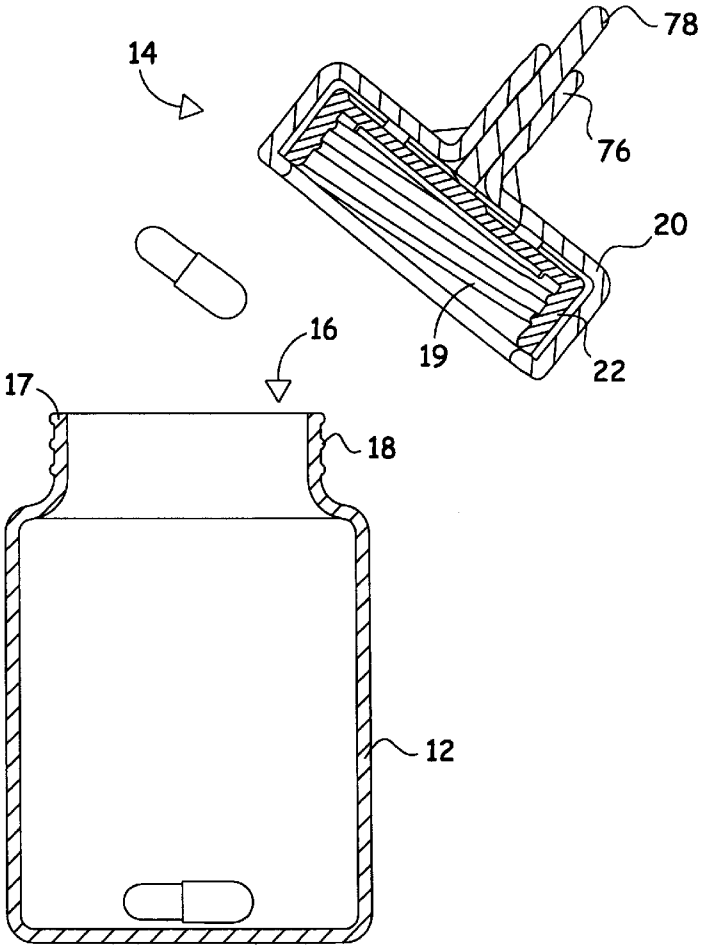
FIG. 14 is a cross-sectional side view of the container assembly, according to the invention, showing the cap assembly unscrewed from the container.
Figure 13:
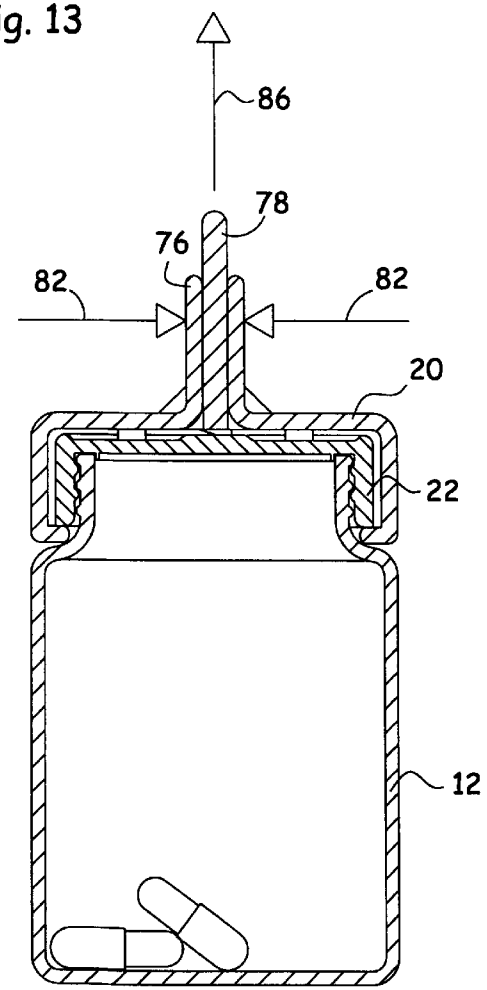
FIG. 13 is a cross-sectional side view of the container assembly according to the invention, similar to that shown in FIG. 12.

In operation, referring now to FIGS. 12, 13, and 14, to remove cap assembly 14 from body 12 and open container 10, each grasping member 76 is first squeezed towards each other (as represented by arrows 82 in FIGS. 12 and 13) and also squeezed against each respective side of handle 78 by an adult user. In doing so, each grasping member 76 effectively pivots each respective hinging section 58 about hinge axis 64, placing each hinging section 58 into its engaged position, as defined above. To ensure minimum flex between each grasping member 76 and its respective hinging section 58, a reinforcement boss 84 may be provided, as required and as understood by those skilled in the art. As each hinging section 58 pivots to its engaged position, engagement tabs 66 move against roof surface 28 of retainer 22, eventually dropping into any four of eight (in this example) of engagement recesses 30. At this point, the adult user merely rotates the combination grasping members 76 and handle 78 counter-clockwise to force each contact wall 68 of each respective engagement tab 66 to abut against each respective opening wall 34 of the selected engagement recesses 30 so that further counter-clockwise rotation of skirt 20 forces retainer 22 to also rotate, thereby unscrewing threads 19 of retainer 22 from engagement with threads 18 of body 12, and opening container 10.

An important aspect of the present invention is that the applied force (arrows 82 in FIGS. 12 and 13) to open the container is transverse to the direction cap assembly 14 will move as it is unscrewed from body 12 (represented by arrow 86 in FIG. 13). In other words, by squeezing grasping members 76 against handle 78, the adult user will automatically engage skirt 20 (and therefore grasping members 76 and handle 78) with retainer 22 and may then rotate cap assembly 14 effortlessly from body 12 without fighting against the engagement force as was the case in conventional "push and turn" child-resistant containers. Applicant contends that grasping members are easier to operate (i.e., squeeze together) than the conventional "push and turn" containers.

To re-secure cap assembly 14 to body 12, threads 19 of retainer 22 are repositioned onto threads 18 of body 12. Any clockwise rotation of any portion of skirt 20 will force closing ratchets 70 to engage adjacent closing walls 36 of any selected engagement recesses 30 thereby forcing retainer 22 to also rotate clockwise and thereby closing container 10.

The preferred material of body 12, retainer 22 and skirt 20 is any suitable plastic, such as high density polyethylene. The number, size and particular shape of engagement tabs 66, closing ratchets 70, engagement recesses 30, retainer 22, skirt 20, grasping members 76 and handle 78 of course may vary depending on the exact requirements of the container, the size and shape of the container, the type of contents, the specific environment of intended use, the material used to manufacture the parts, and the method of manufacture. Any and all of these parts may be modified, or changed in number, without departing from the generally scope of the invention.

Although two opposing grasping members 76 are preferred, according to another embodiment, not shown, a skirt includes only a single grasping member and an single handle. To operate, the user merely squeezes the grasping member against the handle to engage the skirt with the retainer.

Also, according to another embodiment of the invention, not shown, two grasping members 76 are used, as the embodiment shown in the Figures, however, no handle 78 is included. Grasping members 76 include an interfitting surface which engages whenever grasping members 76 are squeezed together. This interfitting surface provides sufficient frictional engagement to allow the squeezed grasping members to function as a rigid handle 78. This version may be easier to injection mold.

Handle 78, if provided with container 10, includes an opening 79 which may be used to hang container 10 from a conventional hanger rod typically found in stores. Opening 79 also serves to receive a securing clip 90, as described in greater below.

Any appropriate manufacturing method may be used to manufacture cap assembly 14. As discussed above, retainer 22 may be conventional, while skirt 20 may be formed either as a single piece or in two or more sections and later secured together, as understood by those skilled in the art. Applicant contemplates molding grasping members 76, handle 78, hinging sections 58 including engagement tabs 66 and closing ratchets 70, integrally as one piece, and separately molding side wall 42 of skirt 20 and later attached these two parts together using any appropriate bonding technique.

Figure 16:
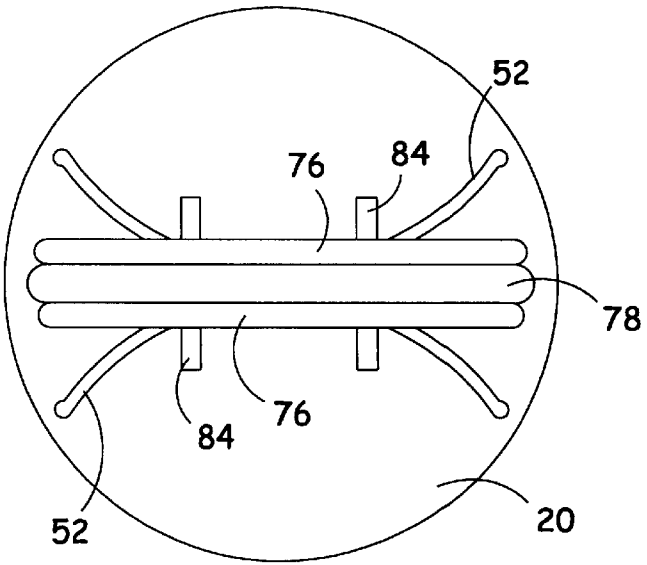
FIG. 16 is a top plan view of the cap assembly, according to the invention, showing details of the grasping members in the engaged position.
Figure 15:
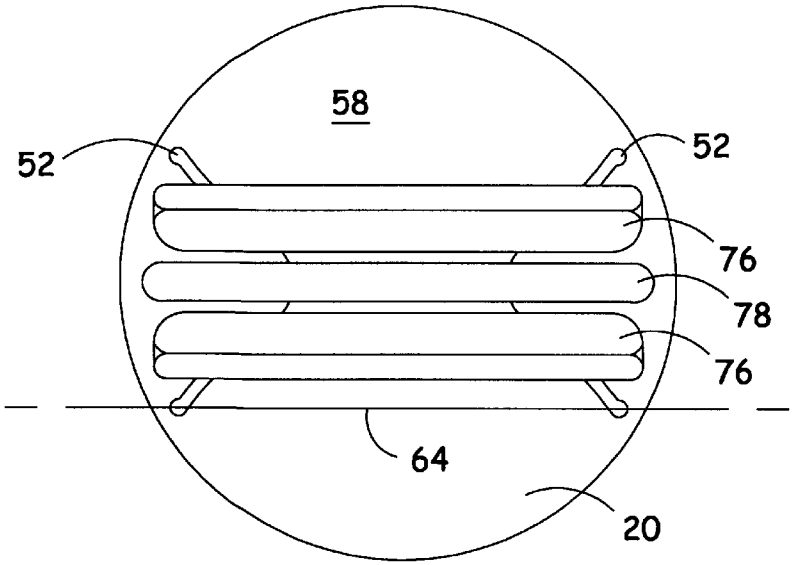
FIG. 15 is a top plan view of the cap assembly, according to the invention, showing details of the grasping members in the disengaged position.
Figure 18:
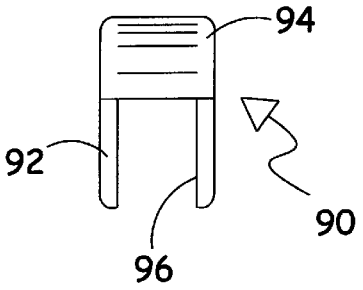
FIG. 18 is a side view of the locking clip of FIG. 17.
Figure 19:
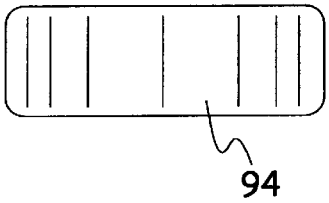
FIG. 19 is a top view of the locking clip of FIG. 17.
Figure 17:
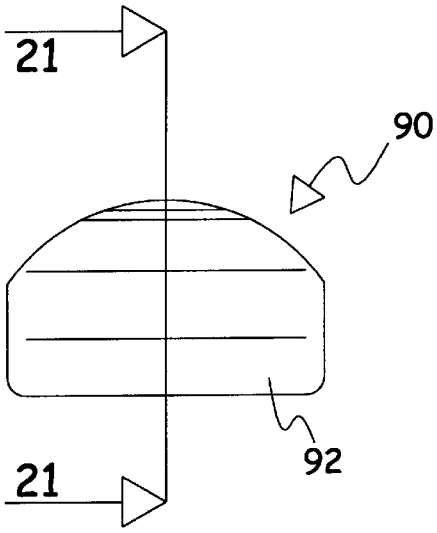
FIG. 17 is front view of a locking clip, according to the invention.
Figure 21:
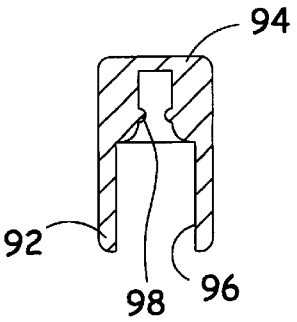
FIG. 21 is a sectional view of the locking clip, taken along the line 21—21 of FIG. 17.
Figure 20:
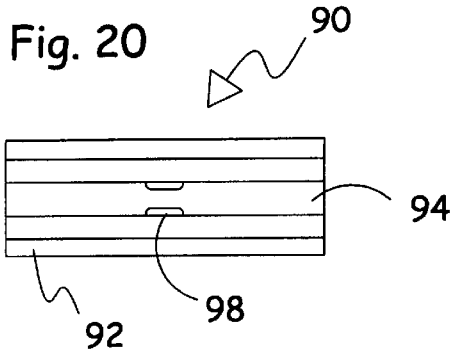
FIG. 20 is a bottom view of the locking clip of FIG. 17.

Referring to FIG. 15, a top plan view of cap assembly 14 is shown in a disengaged position, with grasping members 76 in their rest position. FIG. 16 shows a top plan view of cap assembly with grasping members 76 squeezed against handle 78.

Referring to FIGS. 17 through 21 a securing clip 90 is shown according to another embodiment of the invention. Clip 90 is generally U-shaped, defining two side walls 92 and an upper wall 94. Located along an inner surface 96 of each side wall 92 is a latching detent 98. Clip 90 is sized and shaped to snugly fit onto handle 78 so that latching detents 98 align and engage with opening 79.

Figure 22:
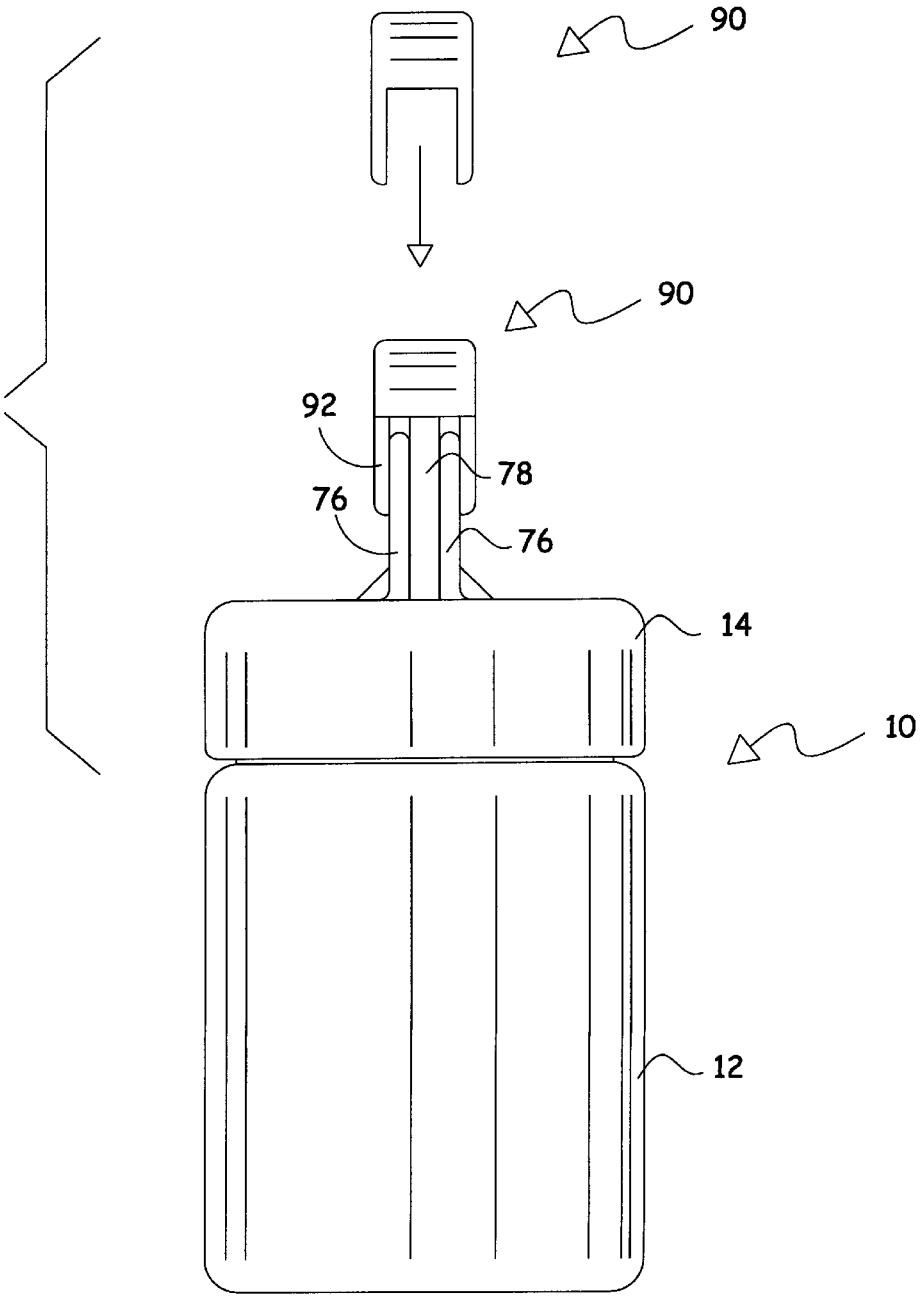
FIG. 22 is a side view of the container and cap assembly showing the locking clip being secured to the handle so that the opposing grasping members are secured in their disengaged position, according to the invention.
Figure 23:
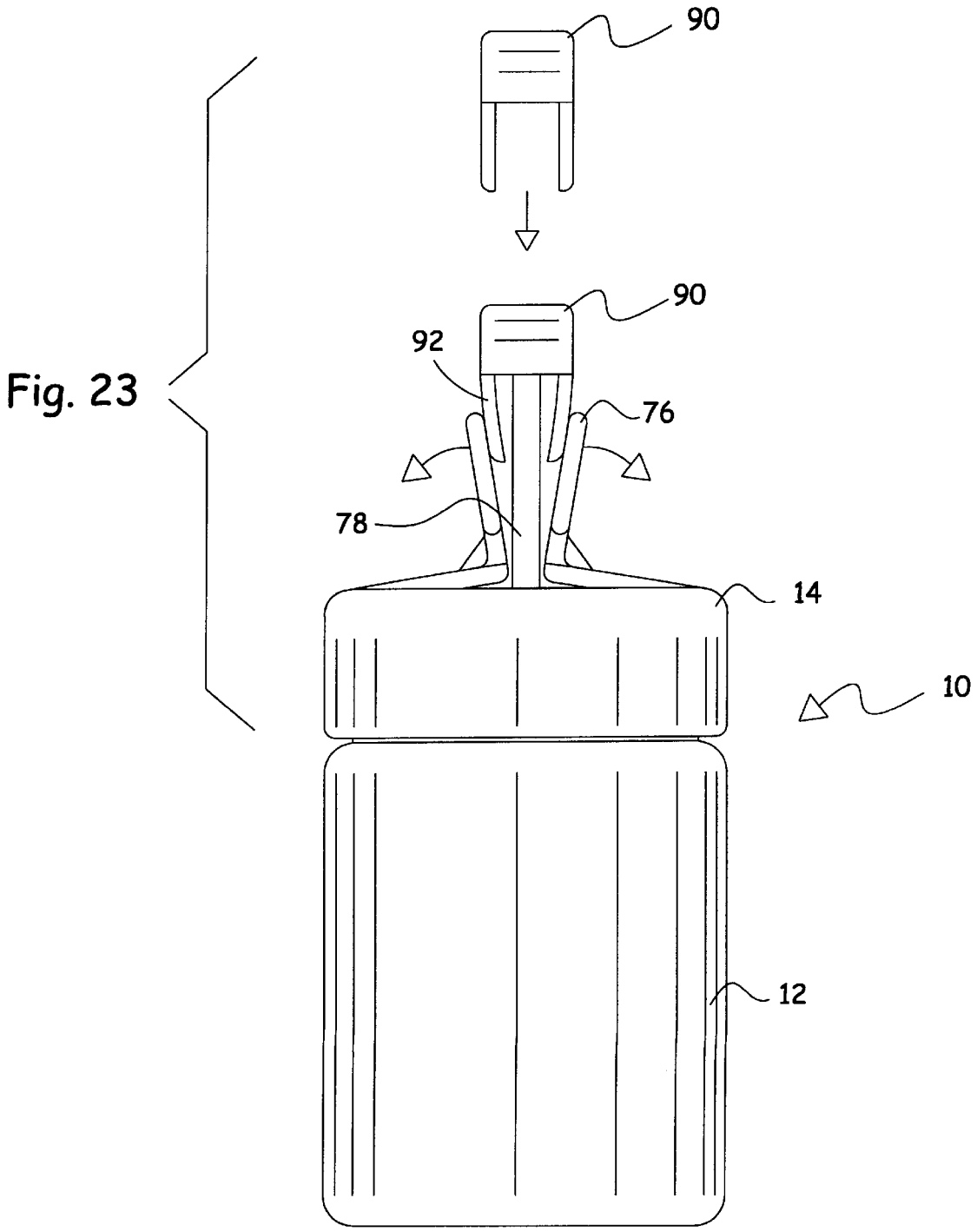
FIG. 23 is a side view of the container and cap assembly showing the locking clip being secured to the handle so that the opposing grasping members are secured in their engaged position, according to the invention.

Clip 90 may be used to hold grasping members 76 in either their disengaged position, as shown in FIG. 23, or in their engaged position, as shown in FIG. 22. By holding grasping members 76 in their disengaged position, an addition level of security against inadvertent entry is provided because a user must first remove clip 90 from engagement with opening 79 and then open container 10 by squeezing the now free grasping members 76 and turning handle 78, as discussed above.

By using clip 90 to hold grasping members in their engaged position, as shown in FIG. 22, the container loses all security and may be freely opened merely by rotating handle 78 at any time. This feature is particularly useful in environments where no children are or will be present.

Figure 25:
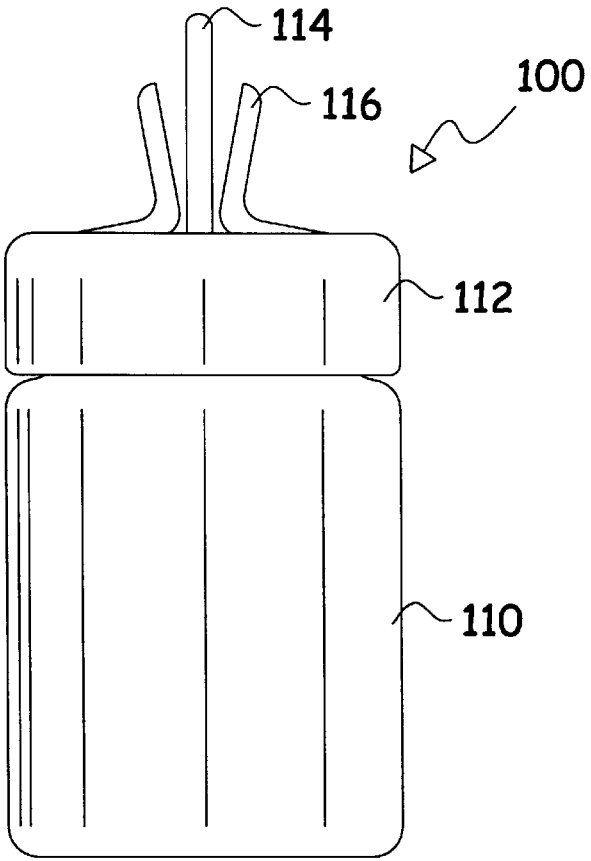
FIG. 25 is a side view of the container shown in FIG. 24, according to the invention.
Figure 24:
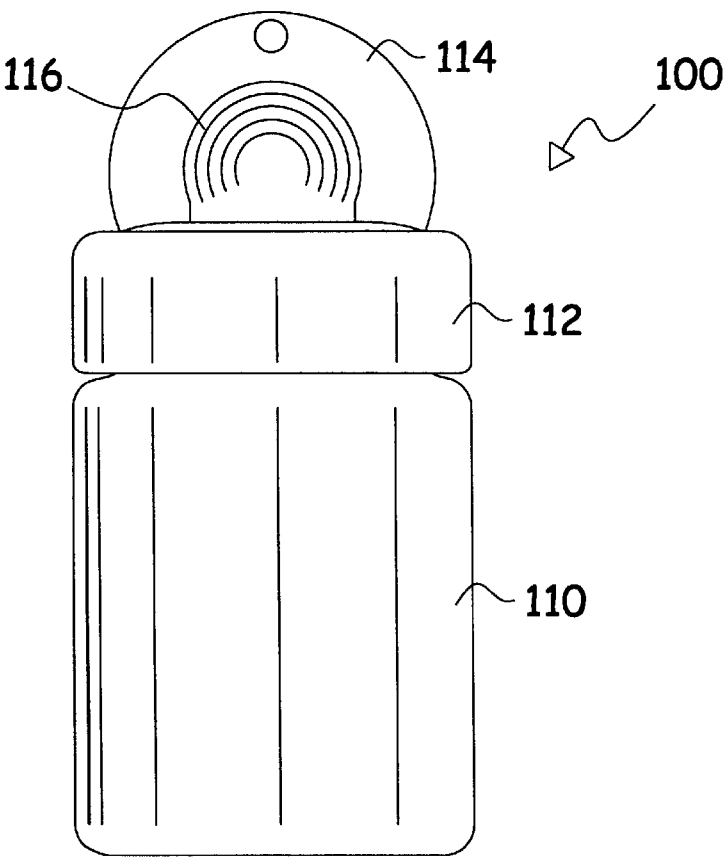
FIG. 24 is a front view of a container according to another embodiment of the invention showing an arcuate handle and grasping members.

Referring now to FIGS. 24 and 25, a container 100 according to another embodiment of the invention is shown including a body 110 and a cap assembly 112. Cap assembly 112 is similar to cap assembly 14, described above including a handle 114 and two pivotal opposing grasping members 116. According to this embodiment, grasping members are generally circular in shape, not rectangular as in earlier embodiments. Handle 114 is sized and shaped with respect to grasping members 116 to prevent or at least discourage the fingers of a small hand, such as those of a child from reaching around handle 114 and squeezing together grasping members 116. The purpose of this embodiment is to illustrate the importance of the relative size and shape of grasping members 116 with respect to handle 114. Of course, grasping members 116 and handle 114 may be any of a variety of shapes and sizes without departing from the gist of the present invention.

The thickness of hinging sections 58 along hinge axis 64 may be carefully controlled to vary the inherent spring bias of the material used to mold cap assembly 14. As understood by those skilled in the art, generally, the thicker hinging sections 58 are made, the greater the spring bias of hinging sections 58 and the greater the squeezing force required to pivot each hinging section 58 from their rest, disengaged position to their engaged position. The thickness of hinging sections 58 may therefore be used to control the level of child-resistance and also the level of senior-friendliness of container 10.

What is claimed is:

1. A container comprising:

a body having an opening;

screw threads located on said body around said opening;

a cap assembly, said cap assembly comprising:

a retainer sized and shaped to be selectively secured to said body, said retainer having screw threads that are adapted to be selectively engaged with said screw threads of said body;

a shell surrounding said retainer, said shell being rotatable with respect to said retainer;

at least one grasping member located on said shell, said at least one grasping member being pivotal between a disengaged position, wherein said shell freely rotates with respect to said retainer, and an engaged position, wherein said shell engages with said retainer so that both said shell and said retainer rotate together with respect to said body, pivotal movement of said at least one grasping member from said disengaged position to said engaged position automatically forcing said shell into engagement with said retainer; and a spring bias to encourage said at least one grasping member to said disengaged position.

2. The container, according to claim 1, wherein said shell includes a flat upper surface and said at least one grasping member extends upwardly from said flat upper surface.

3. The container, according to claim 1, wherein said at least one grasping member comprises two opposing grasping members pivotally attached to said shell, said opposing grasping members being apart from each other in said disengaged position and generally adjacent to each other in said engaged position.

4. The container, according to claim 3, further comprising a handle rigidly attached to said shell, said handle being positioned between said two opposing grasping members.

5. The container, according to claim 3, further comprising a locking element selectively positioned between said two opposing grasping members, said locking element preventing pivotal movement of said grasping members from said disengaged position to said engaged position.

6. The container, according to claim 1, further comprising a handle which is rigidly attached to said shell, said handle being positioned so that when said grasping member is in said engaged position, said grasping member lies generally adjacent to said handle.

7. A closure for a threaded container comprising:

a retainer sized and shaped to be selectively secured to said container, said retainer having screw threads that are adapted to be selectively engaged with said screw threads of said container;

a shell surrounding said retainer, said shell being rotatable with respect to said retainer;

at least one grasping member located on said shell, said at least one grasping member being pivotal between a disengaged position, wherein said shell freely rotates with respect to said retainer, and an engaged position, wherein said shell engages with said retainer so that both said shell and said retainer rotate together with respect to said body, pivotal movement of said at least one grasping member from said disengaged position to said engaged position automatically forcing said shell into engagement with said retainer; and a spring bias to encourage said at least one grasping member to said disengaged position.

8. The closure according to claim 7, wherein said shell includes a flat upper surface and said at least one grasping member extends upwardly from said flat upper surface.

9. The closure according to claim 7, wherein said at least one grasping member comprises two opposing grasping members pivotally attached to said shell, said opposing grasping members being separated from each other in said disengaged position and generally adjacent to each other in said engaged position.

10. The closure according to claim 9, further comprising a handle rigidly attached to said shell, said handle being positioned between said two opposing grasping members.

11. The closure according to claim 9, further comprising a locking element selectively positioned between said two opposing grasping members, said locking element preventing pivotal movement of said grasping members from said disengaged position to said engaged position.

12. The closure according to claim 7, further comprising a handle which is rigidly attached to said shell, said handle being positioned so that when said grasping member is in said engaged position, said grasping member lies generally adjacent to said handle.

13. A closure for use with a bottle, comprising:

a retainer having screw threads for selective securement to said bottle, said screw threads being positioned about a first axis;

an outer shell positioned around said retainer, said outer shell being sized and shaped to allow free rotational displacement of said shell about said retainer, said shell including an engagement portion which is displaceable with respect to said retainer along said first axis between an engaged position wherein said shell and said retainer are mechanically engaged to each other, and a disengaged position wherein said shell may freely rotate about said retainer; and means for translating a laterally applied force that is directed along a second axis to linearly displace said engagement portion of said shell along said first axis to said engaged position, said second axis being generally perpendicular to said first axis.

14. The closure according to claim 13, wherein said translation means includes a pair of generally L-shaped grasping members which are pivotally connected to said shell.

15. The closure according to claim 14, wherein said grasping members are formed integrally with said shell.

16. The closure according to claim 13, wherein said engagement portion of said shell includes downwardly directed engagement projections and said retainer includes upwardly directed engagement projections, said engagement projections of said retainer and said shell interlocking when said shell is displaced to its engaged position.

* * * * *